US006112428A

United States Patent [19]

Schaff

[11] Patent Number: 6,112,428

[45] Date of Patent: Sep. 5, 2000

[54] SOLAR POWERED AIR DRYING SYSTEM

[75] Inventor: James Michael Schaff, Jamestown, N. Dak.

[73] Assignee: The United States of America as represented by the Secretary of the Navy, Washington, D.C.

[21] Appl. No.: 09/358,233

[22] Filed: Jul. 21, 1999

[51] Int. Cl.[7] ..... F26B 21/06

[52] U.S. Cl. ..... 34/81; 34/93

[58] Field of Search ..... 34/512, 522, 90, 34/93, 80, 81; 62/9, 94, 244, 271; 96/126, 127; 165/104.12, 4

[56] References Cited

U.S. PATENT DOCUMENTS

| | | | |
|---|---|---|---|
| 2,517,537 | 8/1950 | Anderegg | 34/81 X |
| 4,125,936 | 11/1978 | Prager | 34/93 X |
| 4,189,848 | 2/1980 | Ko et al. | 34/93 X |
| 4,227,375 | 10/1980 | Tompkins et al. | 62/271 X |
| 4,307,519 | 12/1981 | Szucs et al. | 34/80 X |
| 4,368,583 | 1/1983 | Baurmeister | 34/93 |
| 4,948,392 | 8/1990 | Rush | 96/126 X |
| 5,960,560 | 10/1999 | Stoll | 34/93 X |

*Primary Examiner*—Stephen Gravini

*Attorney, Agent, or Firm*—David S. Kalmbaugh; Earl H. Baugher, Jr.

[57] ABSTRACT

A solar powered air drying system which maintains a dry atmosphere inside of a sealed volume. The system uses electricity produced by a solar panel to regenerate daily a desiccant. The desiccant drys the air in a sealed volume which includes the waveguide run and antenna for a Radio Frequency target. The system comprises a solar powered air dryer which operates in conjunction with the natural diurnal temperature cycle. During morning hours, the air volume in the sealed volume is heated by naturally increasing daytime temperatures and the sun and expands, forcing air out of the sealed volume into the solar powered air dryer. The forced air then travels through a desiccant column which includes the desiccant prior to being vented into the environment. Simultaneously, the solar panel provides electrical current to an electric heater which heats the desiccant driving off its stored water. The forced air from the sealed volume then carries the desiccant's moisture with it into the environment. During the afternoon hours, a sun shade begins reducing the solar panel's electrical output, allowing the desiccant to cool to near ambient temperatures. The sealed volume container also cools, drawing in cooler, moister air from the environment through the desiccant column. Since the air first travels through the desiccant, the air is dried before it enters the sealed volume. This regeneration process repeats itself daily.

23 Claims, 2 Drawing Sheets

SOLAR POWERED AIR DRYING SYSTEM

BACKGROUND OF THE INVENTION

1. Field of the Invention

The present invention relates generally to systems for maintaining a dry atmosphere. More specifically, the present invention relates to a solar powered air drying system which maintains a dry atmosphere inside of a sealed volume.

2. Description of the Prior Art

Radio Frequency (RF) targets located at remote sites on military test facilities have a history of degradation caused by moisture condensation inside the target's waveguide run and antenna.

Currently, fuel powered dry air systems are used to pressurize the waveguide run and antenna of radio frequency targets to prevent moisture from corroding the waveguide run and antennas. However, when a fuel powered dry air system at a remote site runs out of fuel, a considerable time period may elapse before personnel return to the site to refuel the system. This allows condensation to occur resulting in corrosion damage to the waveguide run and antenna.

Moisture accumulates within the sealed volume/housing of the waveguide run and antenna of a target because of daily temperature cycles. During the day, air volume temperature increases within the housing pushing a small amount of air out of the housing through leaks and/or openings in the housing. At night, air volume temperature decreases drawing moist air into the housing. As this cycle is repeated over several days, moisture levels within the housing will increase resulting in a sufficient accumulation of moisture within the housing to generate condensation at night when temperatures are generally lower than during the day. This condensation causes corrosion of the targets waveguide run and antenna that will significantly degrade the performance of the target.

Alternative approaches to an air drying system include wrapping the sealed volume/housing inside a sealed bag, adding desiccant to the sealed volume and allowing the sealed volume to breathe through a desiccated breather. Wrapping a waveguide run inside a sealed bag is impractical after the waveguide run is installed in the Radio Frequency target. Placing desiccant inside the sealed volume of the waveguide run and antenna would be effective, however desiccant would interfere with Radio Frequency energy. A branch for housing the desiccant could be added to the waveguide run. Moisture control would be minimal because only a small amount of air would be exchanged between the main waveguide run as the temperature changed. Allowing the sealed volume to breathe is effective, however, it requires that the desiccant be changed periodically.

Accordingly, there is a need for an air drying system for maintaining a dry atmosphere inside of a sealed volume which can be placed at a remote location to prevent corrosion of a target's waveguide run and antenna located within the sealed volume.

SUMMARY OF THE INVENTION

The present invention overcomes some of the disadvantages of the past, including those mentioned above, in that it comprises a relatively simple and highly efficient solar powered air drying system which maintains a dry atmosphere inside of a sealed volume.

The solar powered air drying system operates as a desiccated breather air drying system which uses electricity produced by a solar panel to daily regenerate the desiccant.

The desiccant, in turn, drys the air in a sealed volume of which includes the waveguide run and antenna for a Radio Frequency target.

The solar powered air drying system comprises a solar powered air dryer which operates in conjunction with the natural diurnal temperature cycle. During morning hours, the air volume in the sealed volume of the waveguide run and antenna is heated by the sun and expands, forcing air out of the sealed volume through an air connection pipe into the solar powered air dryer. The forced air then travels through a desiccant column within the solar powered air dryer prior to being vented into the environment.

Simultaneously, the solar panel provides electrical current to an electric heater which heats the desiccant to a temperature of about 250 degrees Fahrenheit, driving off its stored water. The forced air from the sealed volume then carries the desiccant's moisture with it into the environment.

During the afternoon hours, a sun shade begins reducing the solar panel's electrical output, allowing the desiccant to cool to ambient temperatures by late afternoon. In the late afternoon and nighttime hours, the sealed volume of the waveguide run and antenna cools, drawing in cooler, moister air from the environment through the desiccant column. Since the air first travels through the desiccant within the desiccant column, the air is dried before it enters the sealed volume. This regeneration process for the desiccant repeats itself daily.

DETAILED DESCRIPTION OF THE PREFERRED EMBODIMENT

Figure 1:
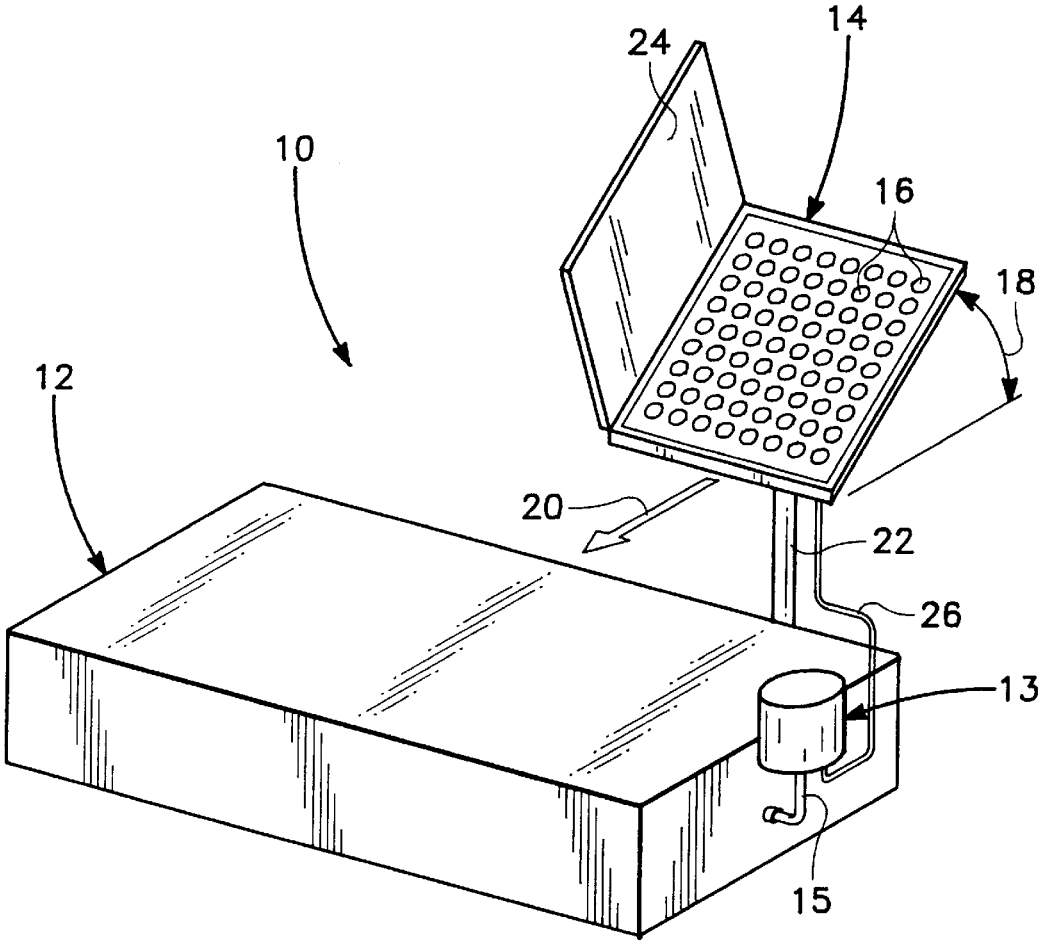
FIG. 1 is a perspective view of the solar powered air drying system comprising the present invention coupled to a sealed volume which includes the waveguide run and antenna of a Radio Frequency target.

Referring to FIG. 1 there is shown a solar powered air drying system, designated generally by the reference numeral 10, which is connected by an air connection pipe 15 to a sealed volume/housing 12. The sealed volume/housing 12 contains the the waveguide run and antenna of a Radio Frequency target which are subject to corrosion when not protected from the effects of moisture entering sealed volume/housing 12. The solar powered air drying system 10 is a desiccated breather air drying system which has its desiccant regenerated daily by electricity from a solar panel, designated generally by the reference numeral 14.

Solar panel 14 includes an array of light sensitive elements or solar cells 16 with each cell 16 converting light or other radiant energy into electricity. Solar panel 14 also includes a rectangular shaped sun shade 24 which is mounted on the left side of the array of solar cells 16 as shown in FIG. 1. Array of solar cells 16 of solar panel 14 is positioned to point South (as indicated by arrow 20) in the Northern Hemisphere. When solar powered air drying system 10 is being used in the Southern Hemisphere, array of solar cells 16 of solar panel 14 is positioned to point North.

To provide for illumination of array 16 without moving panel 14 to track the sun, the user of system 10, by adjusting the solar panel mount mechanism 22, inclines the array of solar cells 16 of solar panel 14 such that a vector normal to the energy producing surface of array of solar cells 16 points North or South of the Zenith, as is appropriate for the Hemisphere, at an angle (indicated by arrow 18) equivalent to the site latitude for system 10.

Array 16 of solar panel 14 delivers sufficient electrical power to solar powered air dryer to allow the desiccant temperature inside of solar powered air dryer 13 to reach 250 degrees Fahrenheit by 1100 hours on a clear day during which the ambient temperature is approximately 60 degrees. Sun shade 24 begins shading array 16 of solar panel 14 at about 1300 hours which reduces the power output of array 16 of solar panel 14. This results in solar powered air dryer cooling during the afternoon near ambient temperatures.

Figure 2:
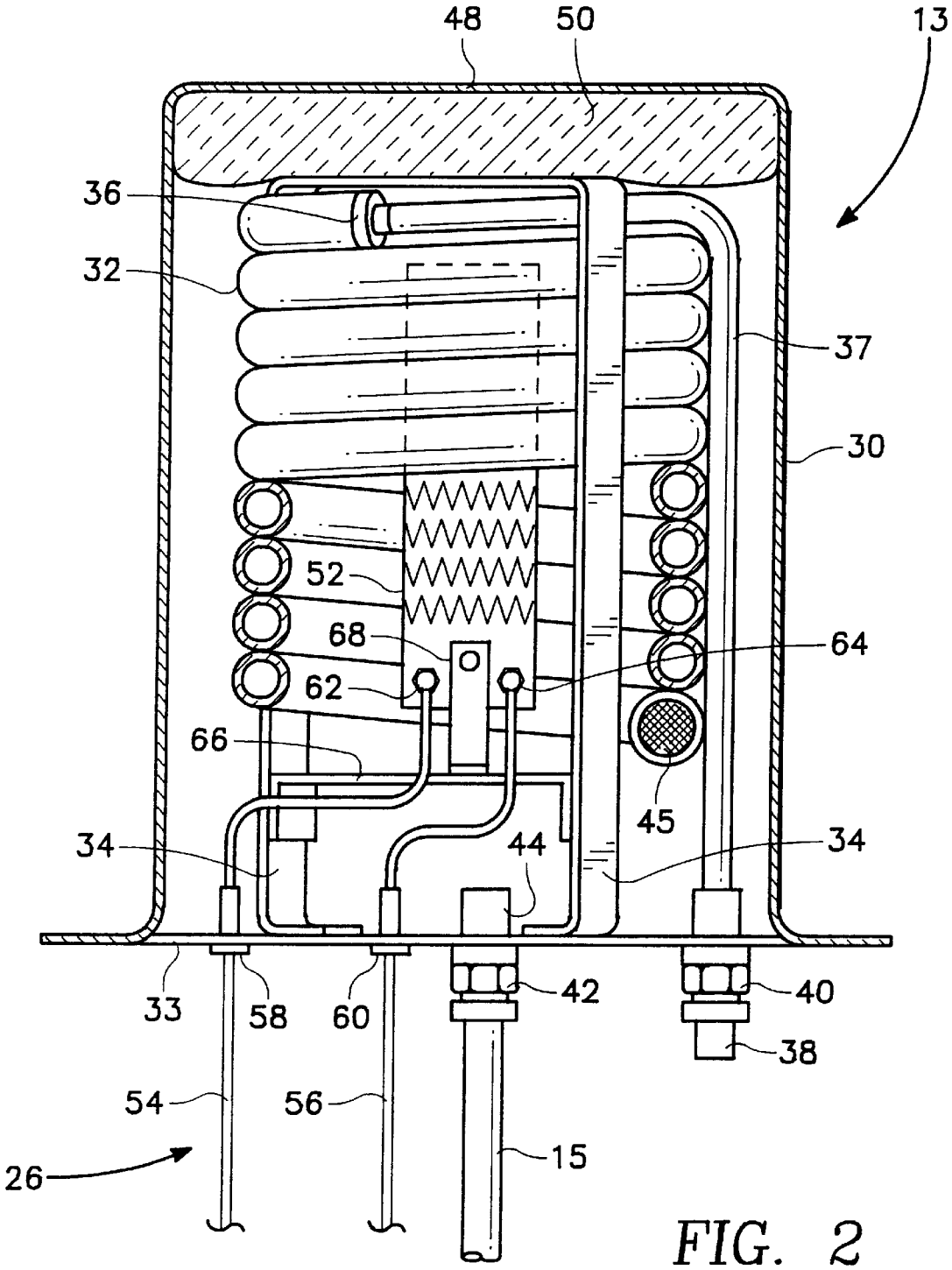
FIG. 2 is a view in section of the air dryer of the system of FIG. 1.

Referring to FIG. 2, solar powered air dryer 13 comprises a desiccant column 32 fabricated from eight feet of one half inch diameter copper tubing shaped as a coil having an outside diameter of four inches. Desiccant column 32 contains the desiccant used in the preferred embodiment of the present invention which is a silica gel desiccant, although it should be understood that other commercially available desiccant may be used with solar powered air drying system 10.

Desiccant column 32 is housed in a sealed sheet metal enclosure or housing 30. The present embodiment of the invention utilizes three generally U shaped support brackets 34, (one being illustrated in FIG. 2). U shaped support brackets 34 are attached to the base plate 33 of enclosure 30 to provide a means of support for desiccant column 32. Support brackets 34 are fabricated from stainless steel to minimize heat transfer to base plate 33.

Sheet metal enclosure 30 and base plate 33 function to protect the internal components of solar powered air dryer 13 from the environment which may range from extreme heat during the daylight hours in a desert environment to relatively cool temperatures at night. Enclosure 30 and base plate 33 are designed to balance the heat-up and cool-down rates of desiccant column 32. Enclosure 30 sufficiently reduces the heat transfer rate to allow desiccant column 32 to reach a temperature of about 250 degrees during daylight hours, while providing a heat transfer rate to allow desiccant column 32 to cool to within approximately five degrees of ambient temperature by sunset.

There is located in the upper portion of enclosure 30 between its top surface 48 and the top of desiccant column 32 a layer of ceramic wool insulation 50. The layer of ceramic wool insulation 50 reduces convection within enclosure 30 and directs energy from an electric heater 52 to desiccant column 32.

One end of desiccant column 32 is connected to a generally L-shaped air exhaust pipe 37 via an exhaust pipe coupler 36. Exhaust pipe coupler 36 has a screen to retain the desiccant within desiccant column 32 while permitting air flow through desiccant column 32. Exhaust pipe 37 is fabricated from stainless steel tubing to minimize heat transfer to base plate 33 of enclosure 30.

A portion 38 of exhaust pipe 37 extends from enclosure 30 into the atmosphere in the manner illustrated in FIG. 2. The length of portion 38 of exhaust pipe 37 is generally short (for example, one to six inches) to prevent icing of portion 38 of exhaust pipe 37 under freezing conditions. Exhaust pipe 37 passes through base plate 33 via a sealed feed through assembly 40 which engages base plate 33 of enclosure 30.

The opposite end of desiccant column 32 is terminated by a retaining screen assembly 45 which vents to the inside of enclosure 30. Retaining screen assembly includes a screen, a threaded cap and a mating threaded fitting. The threaded fitting is attached to desiccant column 32 by soldering the cap to desiccant column 32. Retaining screen assembly 45 allows the manufacturer of solar powered air drying system 10 to load the coil of desiccant column 32 with the desiccant and then contain the desiccant within desiccant column 32. The screen in the threaded cap of retaining screen assembly 45 retains the desiccant within desiccant column 32, while permitting air flow through desiccant column 32.

Referring now to FIGS. 1 and 2, desiccant column 32 is heated by an electric heater 52 which is centrally located within the coil of desiccant column 32 as shown in FIG. 2. Electric heater 52 is attached to a heater support bracket 68 which, in turn, is attached to a support bracket 66. Support bracket 66 is located in the bottom portion of enclosure 30 between the sides of U shaped support brackets 34 and is attached to the sides of support brackets 34 as also shown in FIG. 2.

Electrical power for electric heater 52 is supplied by the array of solar cells 16 of solar panel 14 via a pair of electrical wires 54 and 56 which connect the solar cells 16 of panel 14 to electric heater 52. Electrical wires 54 and 56 respectively pass through base plate 33 of enclosure 30 via a pair of electric feed-throughs 58 and 60. An electrical conduit 26 (FIG. 1) is used to shield wires 54 and 56 from the environment.

Air connection pipe 15, which extends from sealed volume 12 connects to enclosure 30 of solar powered air dryer 13 via a fitting 42 mounted on enclosure 30. A portion 44 of connection pipe 15 extends into the inner portion of enclosure 30 which allows the air connection pipe 15 to vent inside of enclosure 30.

It should be noted that fitting 42 and retaining screen assembly 45 are within enclosure 30 to ensure that the components of system 13 mounted in enclosure 30 are protected from moisture. This prevent corrosion the components inside of solar power air dryer 13 which allows for the continuous operation of solar power air dryer 13 without any adverse consequences which may result from corrosion.

Referring again to FIGS. 1 and 2, when operating solar powered air dryer 13 functions as a desiccated air dryer which regenerates daily by electricity supplied solar panel 14 to solar powered air dryer 13 during daylight hours. Daily regeneration of the desiccant by solar powered air dryer 13 eliminates the need to monitor the desiccant status and replace the desiccant periodically.

The solar powered sir dryer 13 operates in conjunction with the natural diurnal temperature cycle. During the morning hours, air volume in sealed volume/housing 12 is heated and will expand which results in air being forced from sealed volume 12 through air connection pipe 15 into solar powered air dryer 13. Forced air from sealed volume/housing 12 then travels through the desiccant within desiccant column 32 before being vented into the atmosphere through portion 38 of exhaust pipe 37.

Simultaneously, electric heater 52 is heating the desiccant driving stored water from the desiccant. As the air volume within sealed volume/housing 12 continues to expand, air from volume 12 passing through desiccant will carry the desiccant's moisture with it into the atmosphere.

During the afternoon hours, sun shade 24 reduces the electrical current from solar panel 14 to electric heater 52, which results in the desiccant within desiccant column 32 cooling to ambient temperatures by late afternoon. In the late afternoon and at night the sealed volume/housing 12 cools drawing cool moist air through the desiccant which dries the air before the air enters sealed volume 12 via air connection pipe 15. This process repeats itself on a daily basis unless there is cloud cover which prevents solar cells 16 of solar panel 14 from generating electricity during daylight hours. There is, however, stored within the coil of desiccant column 32 adequate desiccant to dry air passing through desiccant column 32 for a time period of seven days without regeneration of the desiccant of system 13.

The system 13 may also include a thermostat mounted within enclosure 30 to limit desiccant temperature to about 250 degrees Fahrenheit. A thermostat was not used in this embodiment of the present invention since the maximum temperature of 250 degrees Fahrenheit occurred for the test environment of 60 degrees Fahrenheit.

From the foregoing, it may readily be seen that the present invention comprises a new, unique and exceedingly a solar powered air drying system for maintaining a dry atmosphere inside of a sealed volume which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A solar powered air drying system for maintaining a dry atmosphere inside of a sealed volume, said sealed volume having a waveguide run and an antenna for a target contained therein, said solar powered air drying system comprising:

conversion means for converting radiant energy from a source into electrical energy;

a solar powered air dryer coupled to said sealed volume allowing air having moisture contained therein to be drawn from the atmosphere through said solar power air dryer into said sealed volume;

a coiled desiccant column mounted within said solar powered air dryer, said coiled desiccant column having a desiccant stored therein, said desiccant removing and then absorbing the moisture from the air drawn from the atmosphere through said solar powered air dryer into said sealed volume, providing dry air to said sealed volume to prevent corrosion of the waveguide run and antenna for said target heating means for receiving said electrical energy from said conversion means, said heating means, responsive to said electrical energy, heating said coiled desiccant column removing the moisture from said desiccant allowing dry air expelled from said sealed volume to carry the moisture removed from desiccant into the atmosphere.

2. The solar powered air dryer of claim 1 wherein said conversion means comprises a solar panel positioned in proximity to said sealed volume, said solar panel including an array of light sensitive elements for converting said radiant energy into said electrical energy, said solar panel having a rectangular shaped sun shade mounted on one side of said array of light sensitive elements.

3. The solar powered air drying system of claim 2 wherein said array of light sensitive elements comprises an array of solar cells.

4. The solar powered air drying system of claim 1 wherein said coiled desiccant column is fabricated from an eight feet section of one half inch diameter cooper tubing shaped as a coil having an outside diameter of four inches.

5. The solar powered air drying system of claim 1 wherein said desiccant comprises a silica gel desiccant.

6. The solar powered air drying system of claim 1 wherein said heating means heats said coiled desiccant column to a temperature of about 250 degrees Fahrenheit to remove the moisture from said desiccant.

7. A solar powered air drying system for maintaining a dry atmosphere inside of a sealed volume, said sealed volume having a waveguide run and an antenna for a target contained therein, said solar powered air drying system comprising:

a solar panel positioned in proximity to said sealed volume, said solar panel including an array of light sensitive elements for converting radiant energy into electrical energy;

a solar powered air dryer coupled to said sealed volume allowing air having moisture contained therein to be drawn from the atmosphere through said solar power air dryer into said sealed volume;

a coiled desiccant column mounted within said solar powered air dryer, said coiled desiccant column having a desiccant stored therein, said desiccant removing and then absorbing the moisture from the air drawn from the atmosphere through said solar powered air dryer into said sealed volume, providing dry air to said sealed volume to prevent corrosion of the waveguide run and antenna for said target; and an electric heater mounted within said solar powered air dryer in proximity to said coiled desiccant column, said electric heater being connected to the array of light sensitive elements of said solar panel to receive said electrical energy from the array of light sensing elements, said electric heater, responsive to said electrical energy, heating said coiled desiccant column removing the moisture from said desiccant allowing dry air expelled from said sealed volume to carry the moisture removed from desiccant into the atmosphere.

8. The solar powered air drying system of claim 7 wherein said solar panel has a rectangular shaped sun shade mounted on one side of said array of light sensitive elements.

9. The solar powered air drying system of claim 7 wherein said array of light sensitive elements comprises an array of solar cells.

10. The solar powered air drying system of claim 7 wherein said coiled desiccant column is fabricated from an eight feet section of one half inch diameter cooper tubing shaped as a coil having an outside diameter of four inches.

11. The solar powered air drying system of claim 7 wherein said desiccant comprises a silica gel desiccant.

12. The solar powered air drying system of claim 7 wherein said electric heater heats said coiled desiccant column to a temperature of about 250 degrees Fahrenheit to remove the moisture from said desiccant.

13. The solar powered air drying system of claim 7 further comprising an air connection pipe having one end connected to said sealed volume and the opposite end connected to said solar powered air dryer.

14. The solar powered air drying system of claim 7 further comprising a solar panel mount mechanism coupled to said solar panel, said solar panel mount mechanism allowing for angular adjustment of the array of light sensitive elements of said solar panel.

15. A solar powered air drying system for maintaining a dry atmosphere inside of a sealed volume, said sealed volume having a waveguide run and an antenna for a target contained therein, said solar powered air drying system comprising:

a solar panel positioned in proximity to said sealed volume, said solar panel including an array of light sensitive elements for converting radiant energy into electrical energy; said solar panel having a rectangular shaped sun shade mounted on one side of said array of light sensitive elements;

a solar powered air dryer coupled to said sealed volume allowing air having moisture contained therein to be drawn from the atmosphere through said solar power air dryer into said sealed volume, said solar powered air dryer comprising:

an enclosure having a base plate;

a coiled tubular shaped column mounted within said enclosure;

a U-shaped support bracket attached to the base plate of said enclosure, said U-shaped support bracket having said coiled tubular shaped column affixed thereto;

a layer of insulation located in the upper portion of said enclosure above said coiled tubular shaped column;

an electric heater positioned within said coiled shaped column, said electric heater being connected to the array of light sensitive elements of said solar panel to receive said electrical energy from the array of light sensing elements;

said coiled tubular shaped column having a desiccant stored therein, said desiccant removing and then absorbing the moisture from the air drawn from the atmosphere through said solar powered air dryer into said sealed volume, providing dry air to said sealed volume to prevent corrosion of the waveguide run and antenna for said target; and said electric heater, responsive to said electrical energy, heating said coiled desiccant column removing the moisture from said desiccant allowing dry air expelled from said sealed volume to carry the moisture removed from desiccant into the atmosphere.

16. The solar powered air drying system of claim 15 wherein said solar panel has a rectangular shaped sun shade mounted on one side of said array of light sensitive elements.

17. The solar powered air drying system of claim 15 wherein said array of light sensitive elements comprises an array of solar cells.

18. The solar powered air drying system of claim 15 wherein said coiled tubular shaped column is fabricated from an eight feet section of one half inch diameter cooper tubing shaped as a coil having an outside diameter of four inches.

19. The solar powered air drying system of claim 15 wherein said desiccant comprises a silica gel desiccant.

20. The solar powered air drying system of claim 15 wherein said electric heater heats said coiled desiccant column to a temperature of about 250 degrees Fahrenheit to remove the moisture from said desiccant.

21. The solar powered air drying system of claim 15 further comprising an air connection pipe having one end connected to said sealed volume and the opposite end connected to the base plate of the enclosure of said solar powered air dryer.

22. The solar powered air drying system of claim 15 further comprising an L-shaped air exhaust pipe mounted within said enclosure, said L-shaped air exhaust pipe having one end of said coiled tubular shaped column connected the re to and the opposite end passing through the base plate of said enclosure into the atmosphere.

23. The solar powered air drying system of claim 15 further comprising a solar panel mount mechanism coupled to said solar panel, said solar panel mount mechanism allowing for angular adjustment of the array of light sensitive elements of said solar panel.

* * * * *